US008069696B2

(12) United States Patent
Sandner

(10) Patent No.: US 8,069,696 B2
(45) Date of Patent: Dec. 6, 2011

(54) METHOD FOR PRODUCING A GEAR WHEEL

(75) Inventor: Christian Sandner, Gmunden (AT)

(73) Assignee: MIBA Sinter Austria GmbH, Laakirchen (AT)

( * ) Notice: Subject to any disclaimer, the term of this patent is extended or adjusted under 35 U.S.C. 154(b) by 412 days.

(21) Appl. No.: 12/226,966

(22) PCT Filed: Apr. 27, 2007

(86) PCT No.: PCT/AT2007/000198
§ 371 (c)(1),
(2), (4) Date: Nov. 3, 2008

(87) PCT Pub. No.: WO2007/128013
PCT Pub. Date: Nov. 15, 2007

(65) Prior Publication Data

US 2009/0090154 A1 Apr. 9, 2009

(30) Foreign Application Priority Data

May 4, 2006 (AT) ..... A 763/2006

(51) Int. Cl.
*B21D 9/08* (2006.01)
*B21D 1/02* (2006.01)
*B21D 3/02* (2006.01)
*B21D 53/28* (2006.01)

(52) U.S. Cl. ..... 72/212; 72/112; 29/893.32

(58) Field of Classification Search ..... 72/112, 72/125, 212, 213, 250, 115, 124; 29/893.32, 29/893
See application file for complete search history.

(56) References Cited

U.S. PATENT DOCUMENTS

| | | | |
|---|---|---|---|
| 5,794,475 | A | 8/1998 | Schuppler et al. |
| 5,865,055 | A | 2/1999 | Morozumi |
| 6,168,754 | B1 | 1/2001 | Woolf et al. |
| 6,357,272 | B1 | 3/2002 | Sandner |
| 2005/0226759 | A1 | 10/2005 | Trasorras et al. |

FOREIGN PATENT DOCUMENTS

| | | |
|---|---|---|
| AT | 406 836 | 9/2000 |
| AT | 412 955 | 9/2005 |
| DE | 195 31 907 | 3/1997 |
| EP | 0 552 272 | 7/1993 |
| JP | 54-146253 | 11/1979 |
| RU | 2 284 241 | 9/2006 |
| WO | WO 00/43148 | 7/2000 |

OTHER PUBLICATIONS

International Search Report.

*Primary Examiner* — Teresa Ekiert
(74) *Attorney, Agent, or Firm* — Collard & Roe, P.C.

(57) ABSTRACT

A method is described for producing a gear wheel from a powdered metal blank (1) compressed and sintered having a machining allowance in the gearing area, the powdered metal blank (1) being compacted by the machining allowance with a plastic deformation by rolling of a compression tool (7) forming a counter gearing engaging in the gearing of the powdered metal blank (1). To provide advantageous compaction conditions, it is suggested that the powdered metal blank (1) be compacted simultaneously around the entire circumference by rolling of profile rolls (8) forming the compression tool (7) axially to the powdered metal blank (1).

5 Claims, 3 Drawing Sheets

METHOD FOR PRODUCING A GEAR WHEEL

CROSS REFERENCE TO RELATED APPLICATIONS

This application is the National Stage of PCT/AT2007/000198 filed on Apr. 27, 2007, which claims priority under 35 U.S.C. §119 of Austrian Application No. A 763/2006 filed on May 4, 2006. The international application under PCT article 21(2) was not published in English.

FIELD OF THE INVENTION

The invention relates to a method for producing a gear wheel from a powdered metal blank compressed and sintered having a machining allowance in the gearing area, the powdered metal blank being compacted in the area of the machining allowance by rolling of a compression tool forming counter gearing engaging in the gearing of the powdered metal blank with a plastic deformation by the machining allowance, and a device for performing the method.

DESCRIPTION OF THE PRIOR ART

To achieve a higher permanent flexural strength in the area of the tooth bases and a higher wear resistance in the area of the tooth flanks in gear wheels produced by powder metallurgy, compacting the sintered powdered metal blanks of the gear wheels in the flank and base areas of the teeth is known (EP 0 552 272 B1, AT 406 836 B), so that a largely nonporous surface layer is obtained, which provides a significant increase of the permissible carrying capacity in the engagement area of the gear wheel. The compaction of the surface layer in the engagement area of the gear wheel is performed via a compression tool in the form of at least one gear wheel, which has either external gearing (EP 0 552 272 B1) or internal gearing (AT 406 836 B) which engages in the gearing of the powdered metal blank, with the aid of which the sliding velocity between the tooth flanks of the powdered metal blank and the compression tool may be decreased. In addition, using a worm which engages in the gearing of the powdered metal blank as the compression tool, whose axis runs transversely to the axis of the powdered metal blank, is known (WO 0043148 A1). However, independently of the type of the compression tool used, the danger exists that the compression forces occurring locally between the compression tool and a mandrel accommodating the gear wheel will cause a plastic deformation of the entire wheel cross-section, which is not only accompanied by inadequate compaction of the two flanks, but rather also results in an impermissible enlargement of the wheel circumference, in particular in gear wheels having a comparatively large internal diameter in relation to the root circle. To avoid this disadvantage, radially chucking the powdered metal blank during its compaction on both front sides over the circumference has already been suggested (AT 412 955 B), which requires additional measures, however, which may not prevent oscillations in the rolling force and thus an oscillation excitation occurring due to alternating overlap conditions, however, which results in increased strain of the tool and the workpiece and therefore a performance limitation.

Finally, providing a matrix tool, which has matrix plates following one another with axial spacing having stepped smaller passage cross-section for the powdered metal blank, which may be pressed axially using a plunger through the matrix tool, is known for compacting the tooth base and the tooth flanks of a gear wheel produced from a compressed and sintered powdered metal blank (U.S. Pat. No. 6,168,754 B1). Because of the simultaneous compaction of the powdered metal blank over the entire external circumference, good dimensional stability may be ensured for the compacted tooth areas. However, this dimensional stability is acquired by an exclusive sliding friction between workpiece and tool, which results in increased wear of the tool and corresponding abrasion on the workpiece.

SUMMARY OF THE INVENTION

The invention is therefore based on the object of implementing a method for producing a gear wheel of the type described at the beginning in such a way that a good dimensional stability of the gear wheel may be ensured during compaction of the teeth, without having to accept excess tool wear or higher tool and/or workpiece strains.

The invention achieves the stated object in that the powdered metal blank is compacted simultaneously over the entire circumference by rolling, axially to the powdered metal blank, of profile rolls which form the compression tool.

By rolling profile rolls having a profile corresponding to the negative shape of a tooth cross-section on the powdered metal blank in its axial direction, firstly a smooth workpiece surface is achieved without abrasion. Because the profile rolls are additionally active simultaneously over the entire external circumference of the powdered metal blank and accordingly load the teeth uniformly and symmetrically, a high dimensional stability may be ensured. The simultaneous compaction of all teeth additionally avoids oscillation excitations, which could result in increased strain of the tool or the workpiece, so that comparatively high processing speeds and thus an improvement of the cost-effectiveness of the production method are possible.

To be able to take an additional influence on the compaction of the tooth surfaces in the area of the machining allowance, the profile rolls may be rolled on the powdered metal blank having a predefinable slip. In such a case, the flowing of the material during the plastic deformation may be at least locally supported by the sliding friction occurring upon a slip between the profile rolls and the workpiece.

To perform the production method, a device may be used as a basis having a retainer for a powdered metal blank of the gear wheel compressed and sintered having a machining allowance and having at least one compression tool, which forms counter gearing engaging in the gearing of the powdered metal blank. For differentiation from known devices of this type, the compression tool comprises a closed collar of profile rolls forming the counter gearing, whose axes lie in a shared plane perpendicular to the axis of the powdered metal blank, the profile rolls being guided in profile grooves, which are parallel to the axis of the powdered metal blank, of a support body enclosing the profile rolls. Because the profile rolls adjoin one another seamlessly in the shared diametrical plane, possibly with elastic pre-tension, and enclose a cross-section corresponding to the intended outline of the gear wheel, an axial retainer for the powdered metal blank which is coaxially displaceable in relation to the support body is sufficient to press the powdered metal blank axially through the cross-section enclosed by the profile roll collar with rolling of the profile rolls along the teeth and compact the teeth of the powdered metal blank in the area of the machining allowance at the same time. The rolling forces occurring may advantageously be dissipated from the profile rolls onto the support body enclosing the profile rolls, which are provided with axial profile grooves for rolling the profile rolls, in which the profile rolls are guided against a lateral offset.

To avoid a mutual displacement of the profile rolls in the direction of the axis of the support body, the profile rolls may be retained in a cage axially displaceable in relation to the support body, which may comprise two plungers accommodating the profile rolls between them in a simple embodiment. Upon free displaceability of such a cage, the profile rolls roll essentially slip-free on one hand on the powdered metal blank and on the other hand in the profile grooves of the support body. However, if the cage is axially displaced at a predefinable velocity in relation to the support body, the rolling movement of the profile rolls may have a sliding movement superimposed, via which influence may be taken on the compaction conditions in the engagement area of the profile rolls.

In order that an axial force necessary for pressing through between the profile rolls is exerted on the powdered metal blank and the powdered metal blank may be axially impinged in the opposite direction, the axial retainer may have two sections which accommodate the powdered metal blank between them. If these sections of the retainer additionally form axial profile grooves corresponding to the tooth gaps of the gear wheel to be produced, the profile rolls may advantageously be guided in these profile grooves and orient the retainer having the powdered metal blank around the circumference.

As already noted, it is of special significant for an advantageous compaction of the teeth of the powdered metal blank that the profile rolls form a closed collar in their entire diametrical plane. To avoid the danger that a machining burr between the abutting profile rolls may form upon tool wear, the profile rolls of the compression tool may contact one another along frontal conical faces, so that upon the plastic compaction of the teeth of the powdered metal blank, penetration of the material between two profile rolls may be prevented, in particular if the profile rolls are pressed against one another with an elastic pre-tension in the contact area.

BRIEF DESCRIPTION OF THE DRAWING

The method according to the invention is described in greater detail on the basis of the drawing. In the figures.

DESCRIPTION OF THE PREFERRED EMBODIMENT

Figure 1:
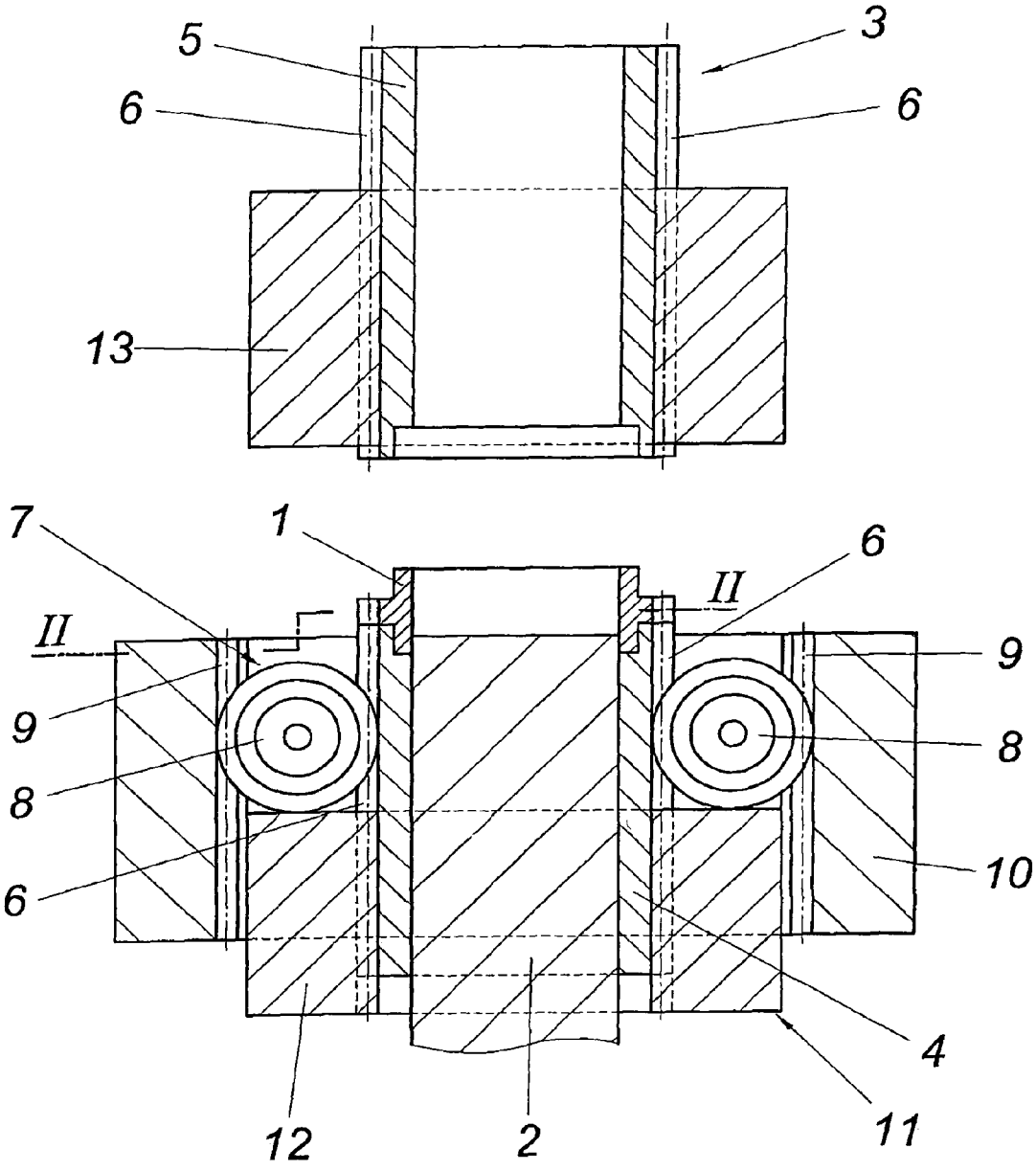
FIG. 1 shows a device according to the invention for producing a gear wheel in a simplified axial section.

The device shown for producing a gear wheel from a compacted and sintered powdered metal blank 1 has a mandrel 2, which radially supports the powdered metal blank 1 in the tooth area at least during its compaction, which is mounted fixed in place according to the exemplary embodiment shown. A retainer 3 made of two sections 4 and 5, which may accommodate the powdered metal blank 1 between them in a formfitting way, is mounted so it is axially displaceable on this mandrel 2. The sections 4 and 5 form axial profile grooves 6 corresponding to the tooth gaps of the gear wheel to be produced. A compression tool 7 is provided for machining the powdered metal blank 1, which comprises a closed collar 18 of profile rolls 8, whose axes lie in a shared diametrical plane perpendicular to the axis of the mandrel 2 and thus to the axis of the powdered metal blank 1. These profile rolls 8 form a counter gearing engaging in the gearing of the powdered metal blank 1, which causes the compaction of the teeth of the powdered metal blank 1 in the area of its machining allowance upon rolling on the powdered metal blank 1. The profile rolls 8 engage in axial profile grooves 9 of a support body 10 enclosing the profile rolls 8 to guide the profile rolls 8 in the direction of the axis of the powdered metal blank 1. In addition, the profile rolls 8 are guided in the profile grooves 6 of the retainer 3, which are thus retained oriented in relation to the profile rolls 8 around the circumference. In order that the profile rolls 8 remain in a shared diametrical plane upon a displacement of the profile rolls 8 along the profile grooves 9 of the support body 10, the profile rolls 8 are guided in a cage 11, which is formed in the exemplary embodiment in a simple way from two plungers 12 and 13 engaging in the annular gap between the support body 10 and the retainer 3 for the powdered metal blank 1, which is not required, of course, however.

Figure 2:
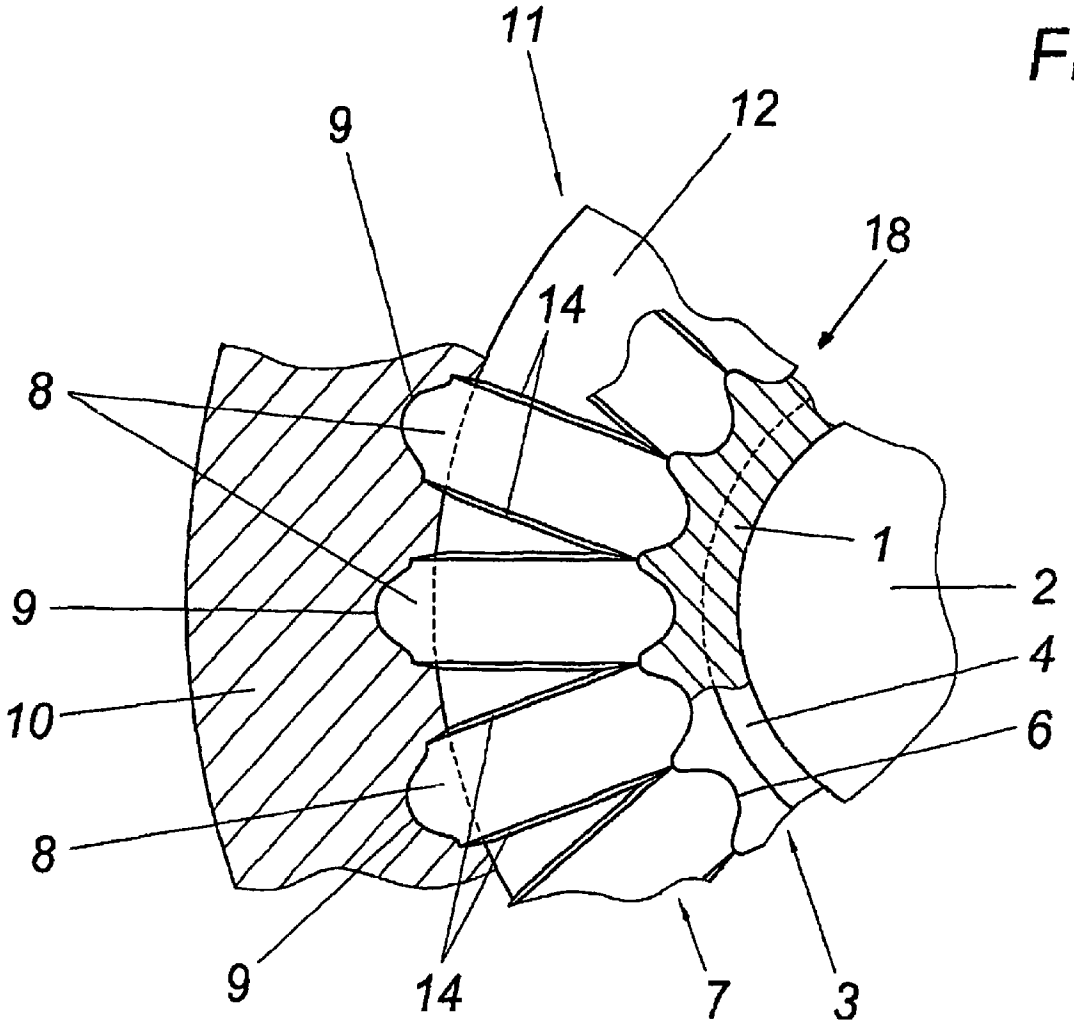
FIG. 2 shows this device in detail in the section along line II-II of FIG. 1 in an enlarged scale.

As may be seen from FIG. 2, the profile rolls 8 have conical faces 14 on their front sides. Because the profile rolls 8 support one another along these frontal conical faces 14, advantageous support conditions result in the area of the tooth heads of the powdered metal blank 1, which prevent an overload of the profile rolls 8 in this area.

Figure 4:
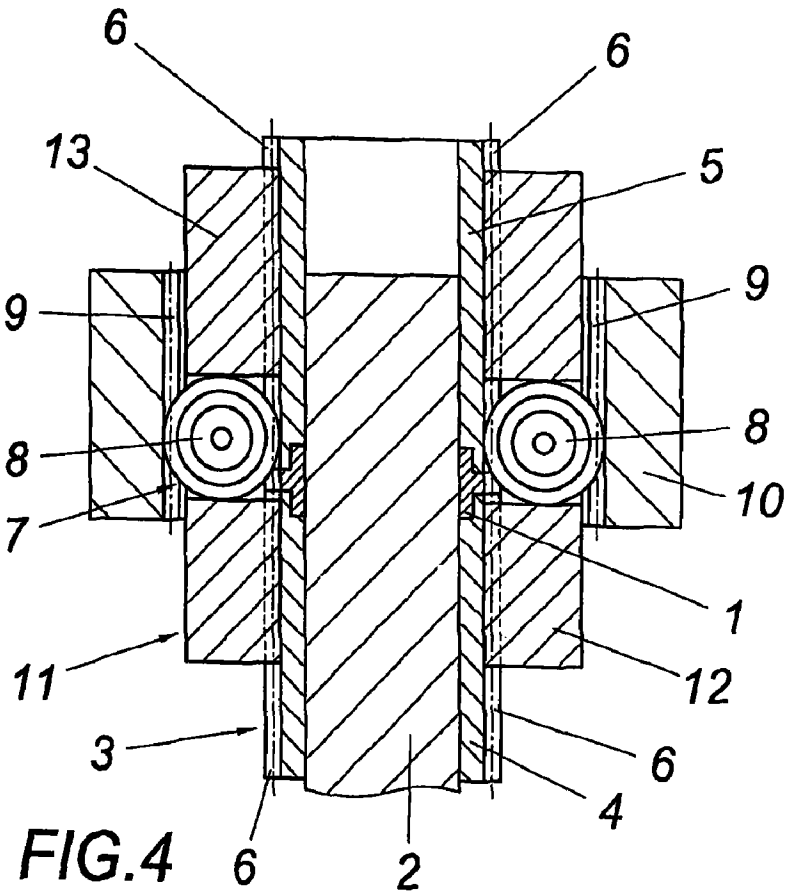
FIGS. 3 and 4 show the device in an illustration corresponding to FIG. 1, but in different operating positions and in a smaller scale.
Figure 3:
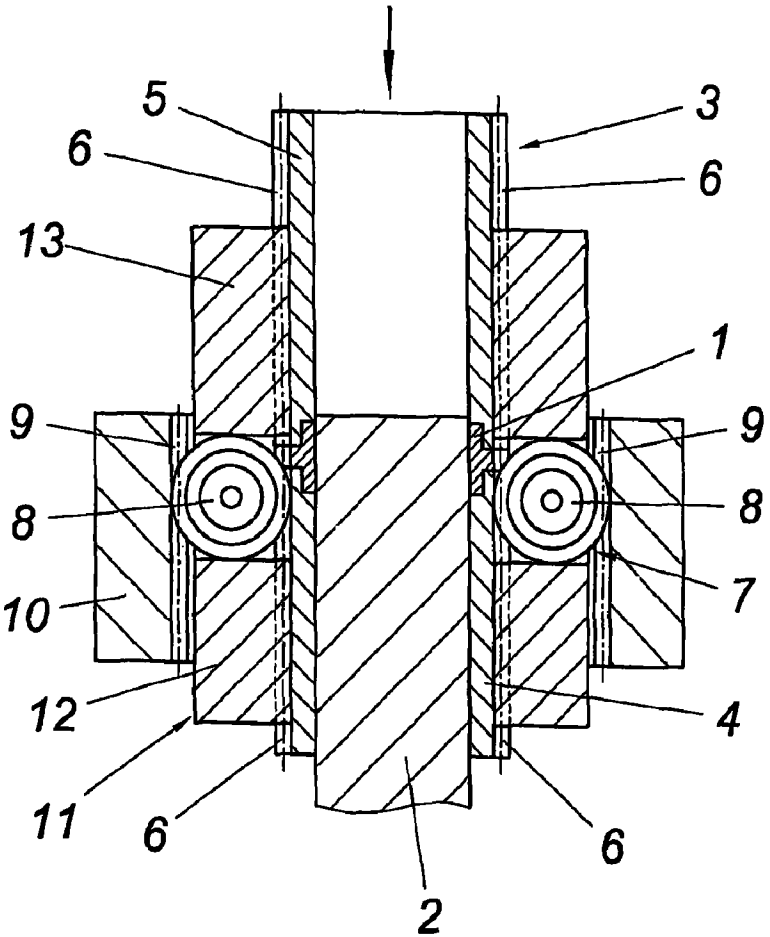

To produce a gear wheel from a sintered powdered metal blank 1, the powdered metal blank 1 is placed appropriately oriented on one retainer section 4 with open retainer 3 as shown in FIG. 1, before the retainer 3 is closed and the plunger 13 of the cage 11 raised with the section 5 of the retainer 3 is lowered toward the collar of the profile rolls 8. To compact the teeth of the powdered metal blank 1, the retainer 3 having the powdered metal blank 1 is now to be axially displaced in relation to the support body 10 to achieve rolling of the profile rolls 8 on the teeth of the powdered metal blank 1 with compaction of the tooth surfaces by the particular machining allowance. According to the exemplary embodiment shown, the support body 10 and the mandrel 2 remain fixed in place while the retainer 3 is axially impinged. The profile rolls 8 roll in the profile grooves 9 of the support body 10 and in the profile grooves 6 of the retainer 3 and over the tooth surfaces of the powdered metal blank 1, which extend the profile grooves 6. The position of the compression tool 7 immediately before and after the compaction of the gearing of the powdered metal blank 1 is shown in FIGS. 3 and 4. As may be inferred from FIGS. 3 and 4, the cage 11 formed by the plungers 12 and 13 is moved along with the profile rolls 8 in the direction of the mandrel axis, so that an essentially slip-free rolling movement of the profile rolls 8 on the powdered metal blank 1 is ensured. The rolling movement of the profile rolls 8 may have a sliding movement superimposed by a deceleration or acceleration of the cage 11. This superposition causes an additional sliding friction in the area of the powdered metal blank 1, with the aid of which the compaction procedure may be influenced.

Of course, the invention is not restricted to the exemplary embodiment. The cage 11 may thus comprise a framework accommodating the profile rolls 8. In addition, because of the simultaneous machining of all teeth of the powdered metal blank 1 by a closed collar of profile rolls 8, it is not required that a mandrel 2 be provided for the radial support of the powdered metal blank 1. In addition, the indexing of the profile rolls may deviate from the tooth indexing, for example, because a profile roll is used for two teeth or separate profile rolls are used for the tooth gaps and the tooth heads. Finally, it is to be noted that the term "gear wheel" used is to be understood to mean not only gear wheels rolling on one another, but rather also chain wheels or wheels having a spline. The invention may be used for the machining of all workpieces which have tooth-like projections distributed around the circumference.

The invention claimed is:

1. A method for producing a gear wheel from a powdered metal blank compressed and sintered having a machining allowance in the gearing area, the powdered metal blank being compacted in the area of the machining allowance by rolling of a compression tool forming counter gearing engaging in the gearing of the powdered metal blank with a plastic deformation by the machining allowance wherein the powdered metal blank is simultaneously compacted over the entire circumference by rolling of profile rolls forming the compression tool axially to the powdered metal blank.

2. The method according to claim 1, wherein the profile rolls roll on the powdered metal blank with a predefinable slip.

3. A device for producing a gear wheel having an axial retainer for a powdered metal blank of the gear wheel, which is compressed and sintered having a machining allowance, and having at least one compression tool, which forms counter gearing engaging in the gearing of the powdered metal blank, wherein the compression tool (7) comprises a closed collar of profile rolls (8) forming the counter gearing, whose axes lie in a shared plane perpendicular to the axis of the powdered metal blank (1), the profile rolls (8) are guided in profile grooves (9), parallel to the axis of the powdered metal blank (1), of a support body (10) enclosing the profile rolls (8), and the axial retainer (3) for the powdered metal blank (1) is coaxially displaceable in relation to the support body (10), wherein the axial retainer (3) has two sections (4, 5), which accommodate the powdered metal blank (1) between them, and which form axial profile grooves (6), corresponding to the tooth gaps of the gear wheel to be produced, and wherein the profile rolls (8) are guided in the axial profile grooves (6).

4. The device according to claim 3, wherein the profile rolls (8) are retained in a cage (11), which is axially displaceable at a predefinable velocity in relation to the support body (10).

5. The device according to claim 4, wherein the profile rolls (8) of the compression tool (7) contact one another along frontal conical faces (14).

* * * * *